US005878763A

United States Patent [19]

Tsai

[11] Patent Number: 5,878,763

[45] Date of Patent: Mar. 9, 1999

[54] CANOPY SUPPORTING STRUCTURE FOR A BI-SECTION FOLDABLE UMBRELIA

[75] Inventor: Chin-Fu Tsai, Changhua, Taiwan

[73] Assignee: Yuan Jinn FWU Co., Ltd., Changhua, Taiwan

[21] Appl. No.: 75,954

[22] Filed: May 12, 1998

[51] Int. Cl.[6] ..... A45B 19/10

[52] U.S. Cl. ..... 135/25.33; 135/30; 135/31

[58] Field of Search ..... 135/20.1, 29, 31, 135/25.33, 23, 26, 27, 30, 32

[56] References Cited

U.S. PATENT DOCUMENTS

| | | | |
|---|---|---|---|
| 145,733 | 12/1873 | Griswold . | |
| 165,093 | 6/1875 | Griswold . | |
| 978,213 | 12/1910 | Rose . | |
| 1,064,994 | 6/1913 | Rose . | |
| 1,083,050 | 12/1913 | Bialozyt . | |
| 1,156,709 | 10/1915 | Rose . | |
| 1,161,139 | 11/1915 | Larsson . | |
| 1,192,638 | 7/1916 | Hull . | |
| 3,831,614 | 8/1974 | Weber . | |
| 3,902,264 | 9/1975 | Radig . | |
| 4,022,233 | 5/1977 | Grundman . | |
| 5,355,903 | 10/1994 | Haddad et al. | 135/20.1 |
| 5,505,221 | 4/1996 | Gao | 135/20.1 |

*Primary Examiner*—Lanna Mai
*Attorney, Agent, or Firm*—Browdy and Neimark

[57] ABSTRACT

An improved canopy structure of a bi-section foldable umbrella is provided with an integrally formed slide block having an upper slider and a lower slider. A fixing mount is integrally connected to the top of the upper slider. The fixing mount, the upper slider and the lower slider are connected to one end of positioning spreaders, extending spreaders and auxiliary spreaders respectively. A canopy is fixedly engaged with some of the spreaders. All the extending spreaders and the auxiliary spreaders are bound together in pairs by an inverted T-shaped member at the middle thereof . At the ends of each paired extending spreader and the auxiliary spreader is disposed a tri-point connector so as to permit an elongated rib downwardly extended from the connector. The periphery of a canopy can thus be vertically supported along the edge thereof for better shelter of a person under the umbrella.

2 Claims, 6 Drawing Sheets

80
821
82
822
70

82
80
60
50
30
70
71
80
40
20'
81
71
60
80
70
71
80
20

CANOPY SUPPORTING STRUCTURE FOR A BI-SECTION FOLDABLE UMBRELIA

BACKGROUND OF THE INVENTION

The present invention relates to an improved canopy supporting -structure of a bi-section foldable umbrella which is provided with an integrally formed slide block having an upper slider and a lower slider. A fixing mount is integrally connected to the top of the upper slider, The fixing mount, the upper slider and the lower slider are connected to one end of positioning spreaders, extending spreaders and auxiliary spreaders respectively. A canopy is fixedly engaged with the spreaders. All the extending spreaders and the auxiliary spreaders are bound together in pairs by an inverted T-shaped binding member at the middle thereof. At the ends of each paired extending spreader and the auxiliary spreader is disposed an F-shaped tri-point connector so as to permit an elongated vertical rib to downwardly extend from the connector. The periphery of a canopy can thus be vertically extended along the edge thereof for better shelter a person under the umbrella.

Referring to FIG. 1, a conventional bi-section foldable umbrella which is comprised of a two-section telescopic shank 20 and a canopy supporting frame made up of a plurality of radially extended spreaders 11 and auxiliary spreaders 17 to hold a canopy A. At the top end of the main shank 20 is disposed a retaining block B, and a slide block C in connection to respective spreaders II by way of horizontal ribs 13 is movably mounted onto the shank 20. The retaining block B is further connected to one end of a-plurality of springs respectively 14 that are coupled to minor ribs 15 at the other end. The minor ribs 15 and the horizontal ribs 13 are both pivotally secured to the spreaders 11 by locking pieces 12. Each spreader 11 is connected to one auxiliary spreader 17 by a connecting piece 16 respectively. Such a canopy structure of a conventional umbrella 10 is able to fully extend the canopy A in an arc plane, but in windy days, rain can be slantly blown to get a person under such an umbrella wet.

SUMMARY OF THE INVENTION

Therefore, the primary object of the present invention is to provide an improved canopy supporting structure which is supported by positioning spreaders, extending spreaders and auxiliary spreaders and vertical ribs which are associated with one another in each group by an inverted T-shaped binding member and an F-shaped tri-point connector. The positioning spreaders, extending spreaders and auxiliary spreaders are connected to an integral slide block and a fixing mount that are movable on a bi-section shank whereby the canopy can be easily extended to provide vertical side extension for better sheltering a person under the umbrella.

Another object of the present invention is to provide an improved canopy supporting structure wherein the canopy is provided with transparent vertical peripheral side extension so as to permit a person to view clearly the front in walking.

DETAILED DESCRIPTION OF THE PREFERRED EMBODIMENT

Figure 1:
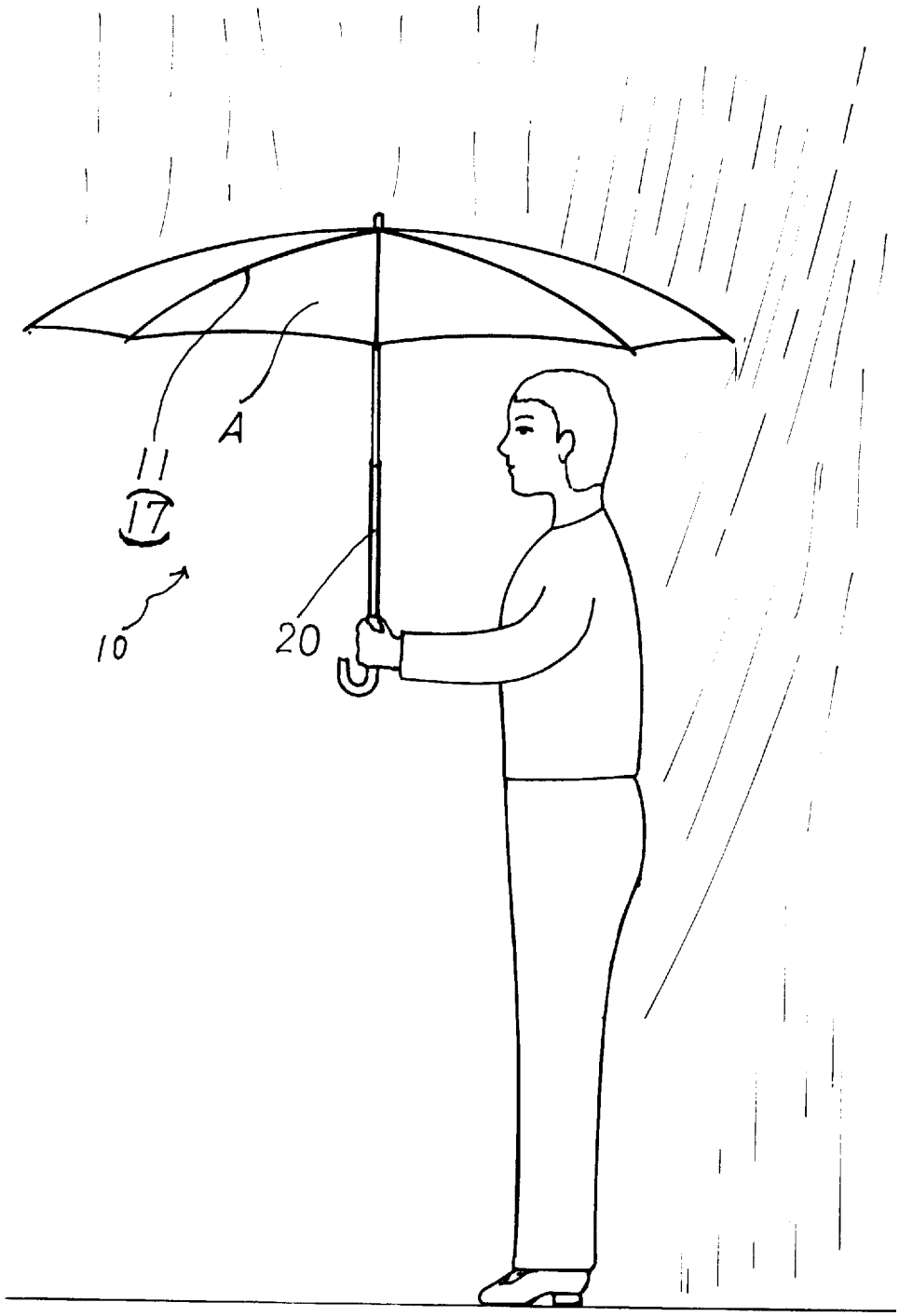
FIG. 1 PRIOR ART
FIG. 1 is a diagram showing a general prior art foldable umbrella.
Figure 1A:
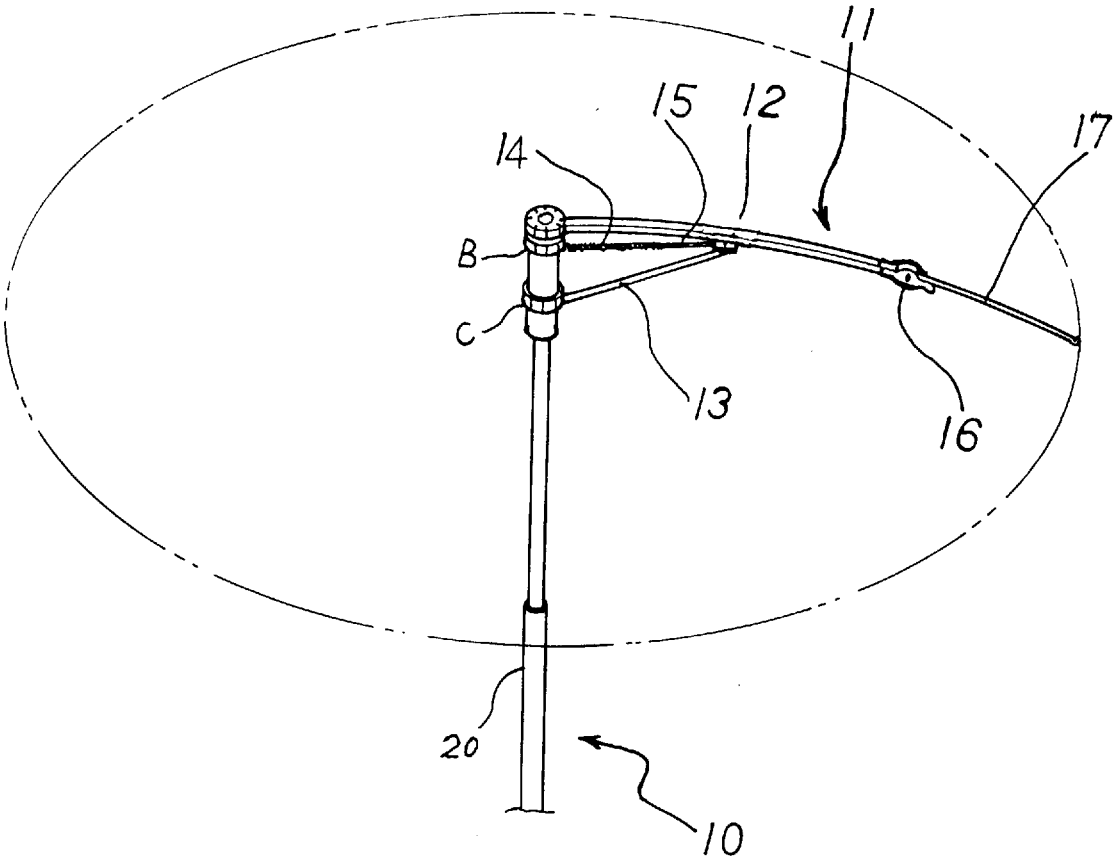
FIG. 1A PRIOR ART
FIG. 1A is a diagram showing a detailed structure of the prior art foldable umbrella of FIG. 1.
Figures 2, 2A, 2B:
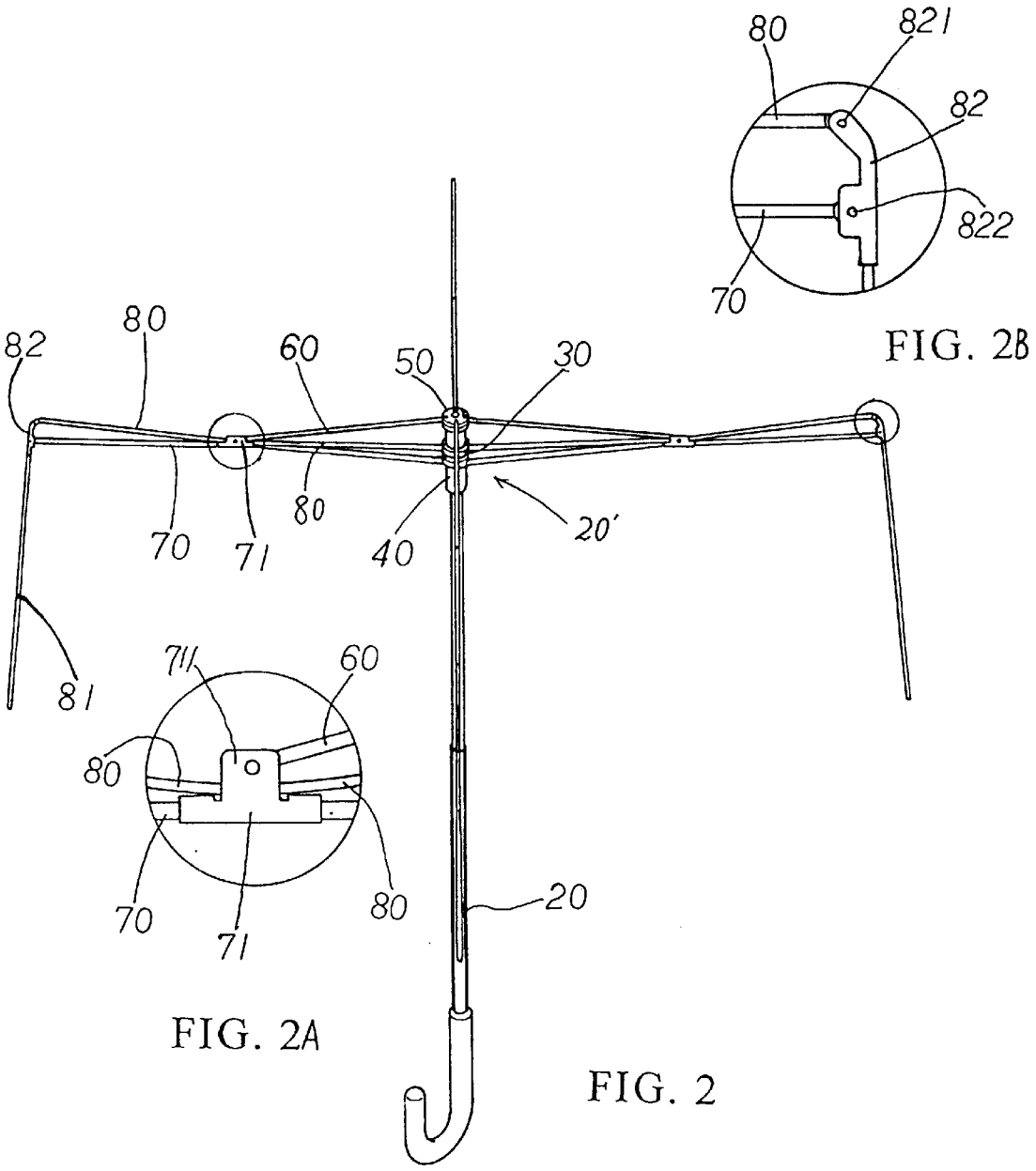
FIG. 2 is a diagram showing the wholly extending canopy supporting frame of the present invention.
FIG. 2A is a diagram showing the inverted T-shaped binding member of the umbrella.
FIG. 2B is a diagram showing an F-shaped tri-point connector of the present invention.

Referring to FIGS. 2, 2A, 2B, the improved canopy supporting structure of a a bi-section foldable umbrella of the present invention is comprised of a bi-section shank 20 with which is movably engaged a slide block 20' having an upper slider 30 and a lower slider 40; a fixing mount 50 integrally fixed to the slide block 20'; a plurality of positioning spreaders 60, extending spreaders 70 and auxiliary spreaders 80. The ends of the positioning spreaders 60, extending spreaders 70 and auxiliary spreaders 80 are respectively pivotally to the fixing mount 50, the lower slider 40 and the upper slider 30. A canopy 90 is secured to the positioning spreaders 60, extending spreaders 70 and auxiliary spreaders 80.

The extending spreaders 70 and the auxiliary spreaders 80 are approximately of equal length. Each extending spreader 70 is equipped with an inverted T-shaped binding member 71 located at the middle thereof and an associated auxiliary spreader 80 is pulled down to be confined in the binding member 71, causing each auxiliary spreader 80 to be in an arc shape so as to make the slide block 20' to be resiliently operated on the shank 20.

As shown in FIG. 2A, the detailed structure of the inverted T-shaped binding member 71 shows that a leg portion 711 of the binding member 71 permits each positioning spreader 60 to be pivotally engaged therewith whereby the positioning spreaders 60, the extending spreaders 70 and the auxiliary spreaders 80 can be all bound together by way of the binding members 71 in groups, permitting all the spreaders to be synchronously actuated when the slide block 21' is moved on the shank 20.

Referring to FIG. 2B, each outer terminal of both the extending spreaders 70 and auxiliary spreaders 80, away from the shank 20, is secured to an F-shaped tri-point connector 82 at two approximately horizontal rivet points 822 and 821 respectively. A vertical rib 81 is connected to a vertical extension of the connector 82 so as to permit the vertical ribs 81 to be perpendicular to the extending spreaders 70 and the auxiliary spreaders 80.

Figure 3:
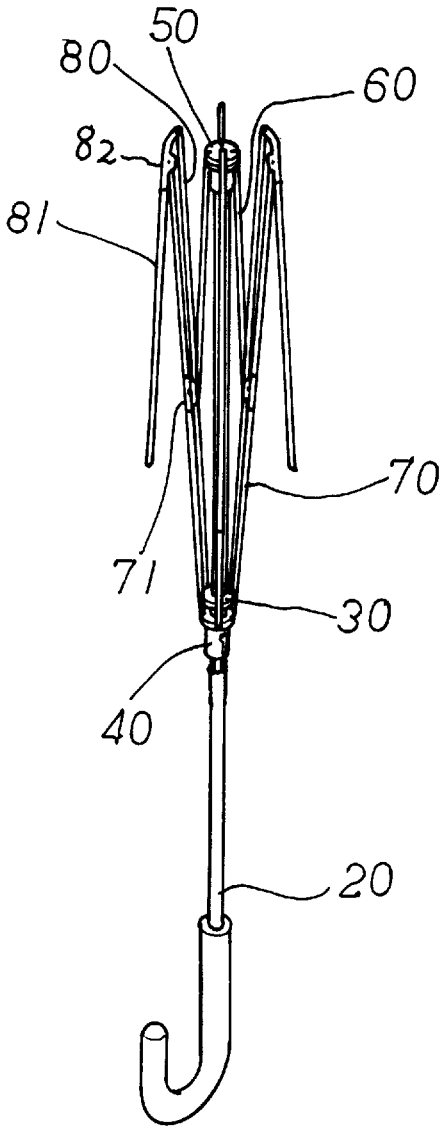
FIG. 3 is a diagram showing the folding of the canopy supporting frame of the present invention.

Referring to FIG. 3, when the lower slider 40 is pulled downwardly, the upper slider 30 will move at the same time, causing the auxiliary spreaders 80 to be vertically collected towards the shank 20 with the help of the positioning spreaders 60 and the extending spreaders 70. In the meanwhile, each extending spreader 70 pushes the F-shaped tri-point connector 82 at the rivet point 821 away from the shank 20 so that each vertical rib 81 is pivotally pulled close towards the shank 20, making the positioning spreaders 60, the extending spreaders 70 and the auxiliary spreaders 80 and the vertical ribs collect together.

Figure 4:
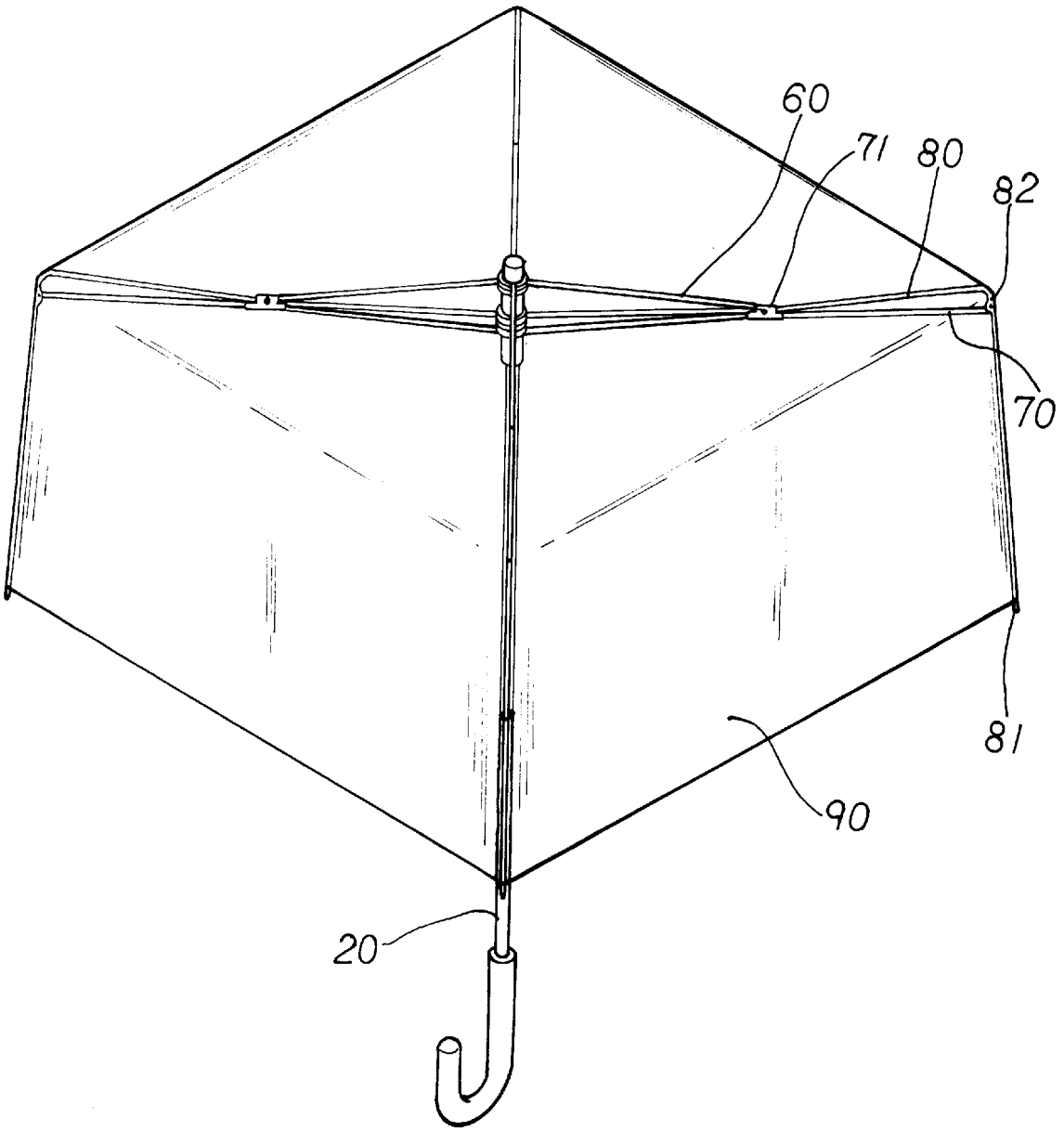
FIG. 4 is a diagram showing the umbrella being halfly extended for use.
Figure 5:
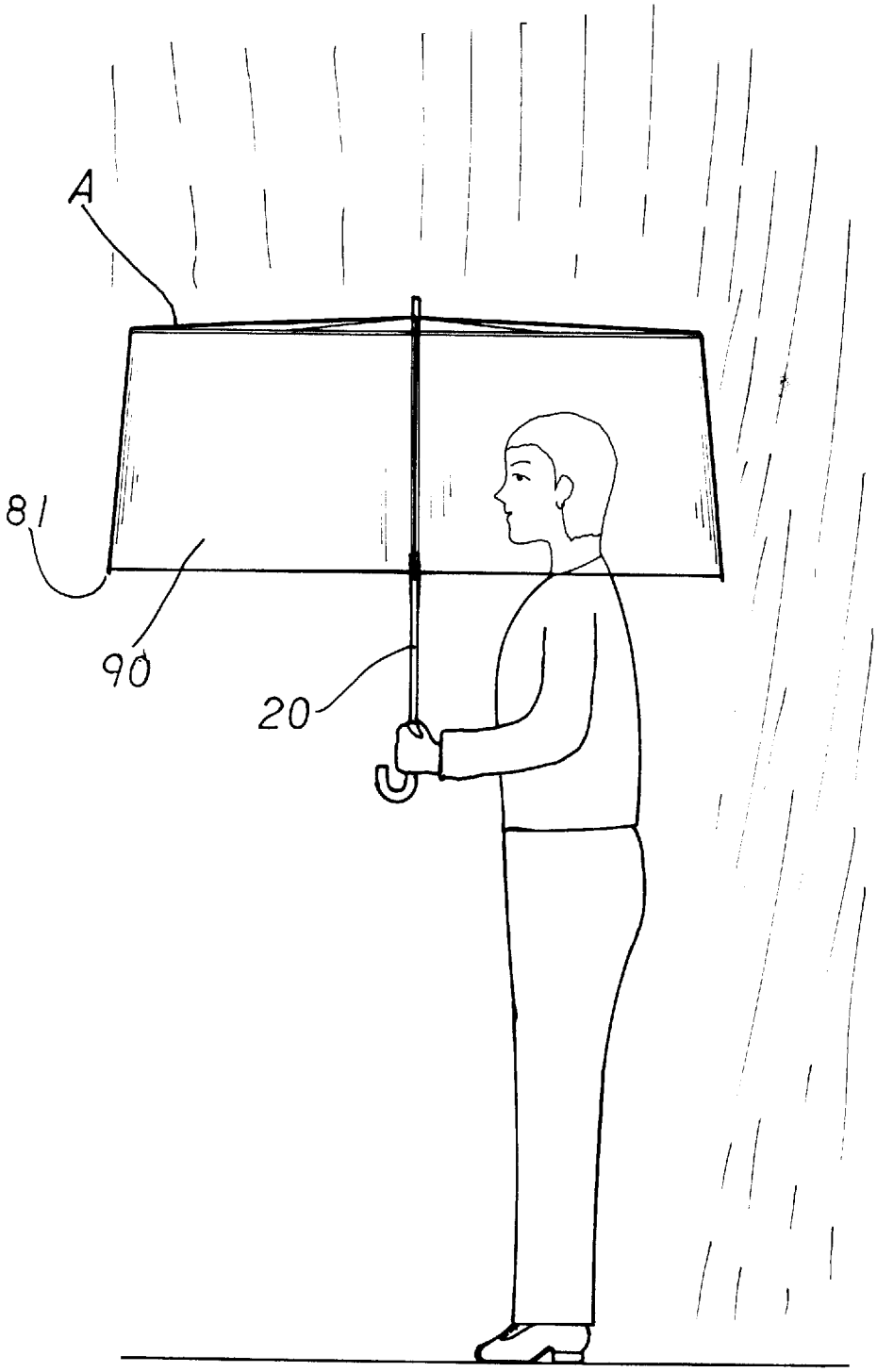
FIG. 5 is a diagram showing the practical use of the umbrella.

Moreover, a canopy A is attached to the auxiliary spreaders 80 and the vertical ribs 81, as shown in FIG. 4, so as to get a tent-like umbrella. As shown in FIG. 5, the vertical ribs

81 enable the canopy A to extend vertically to better shelter a person under an umbrella from getting wet by rain from all directions.

As further shown in FIG. 5, the vertical portion 90 of the canopy A can be made of a transparent material so that a person under such an umbrella can have a better view of the road in the front.

I claim:

1. A canopy supporting structure of a bi-section foldable umbrella comprising a bi-section shank with which is movably engaged a slide block having an upper slider and a lower slider; a fixing mount being integrally fixed to the slide block; a plurality of positioning spreaders, extending spreaders and auxiliary spreaders; the ends of said positioning spreaders, extending spreaders and auxiliary spreaders are respectively pivotally to said fixing mount, the lower slider and the upper slider; a canopy being secured to the positioning spreaders, extending spreaders and auxiliary spreaders; wherein said extending spreaders and said auxiliary spreaders are approximately of equal length; each said extending spreader is equipped with an inverted T-shaped binding member located at the middle thereof and an associated auxiliary spreader is pulled down to be confined in said binding member, causing each said auxiliary spreader to be in an arc shape so as to make said slide block to be resiliently operated on said shank; a leg portion of said binding member permits each positioning spreader to be pivotally engaged therewith whereby said positioning spreaders, said extending spreaders and said auxiliary spreaders can be all bound together by way of said binding members in groups, permitting all the spreaders to be synchronously actuated when said slide block is moved on the shank; each outer terminal of both said extending spreaders and auxiliary spreaders, away from the shank, is secured to an F-shaped tri-point connector at two approximately horizontal rivet points and respectively; a vertical rib is connected to a vertical extension of each said connector so as to permit said vertical ribs to be perpendicular to said extending spreaders and said auxiliary spreaders whereby when said lower slider is pulled downwardly, said upper slider will move at the same time, causing said auxiliary spreaders to be vertically collected towards the shank with the help of said positioning spreaders and said extending spreaders; each said extending spreader pushes said F-shaped tri-point connector at the rivet point away from said shank so that each said vertical rib is pivotally pulled close towards said shank, making said positioning spreaders, said extending spreaders and said auxiliary spreaders and said vertical ribs collect together; a canopy is attached to the auxiliary spreaders and the vertical ribs so as to get a tent-like umbrella; the vertical ribs enable the canopy to extend vertically to better shelter a person under an umbrella from getting wet by rain from all directions.

2. A canopy supporting structure as claimed in claim 1 wherein said vertical portion of said canopy can be made of a transparent material so that a person under such an umbrella can have a better view of the road in the front.

* * * * *